US011124850B2

(12) United States Patent
Kurnsteiner et al.

(10) Patent No.: US 11,124,850 B2
(45) Date of Patent: Sep. 21, 2021

(54) METHOD FOR THE HEAT TREATMENT OF A MANGANESE STEEL PRODUCT, AND MANGANESE STEEL PRODUCT HAVING A SPECIAL ALLOY

(71) Applicant: VOESTALPINE STAHL GMBH, Linz (AT)

(72) Inventors: Philipp Kurnsteiner, Gallneukrichen (AT); Samek Ludovic, Linz (AT); Friedrich Fureder-Kitzmuller, Puchenau (AT); Enno Arrenholz, Plesching (AT)

(73) Assignee: VOESTALPINE STAHL GMBH, Linz (AT)

( * ) Notice: Subject to any disclaimer, the term of this patent is extended or adjusted under 35 U.S.C. 154(b) by 1040 days.

(21) Appl. No.: 15/528,928

(22) PCT Filed: Nov. 30, 2015

(86) PCT No.: PCT/EP2015/078105
§ 371 (c)(1),
(2) Date: May 23, 2017

(87) PCT Pub. No.: WO2016/087392
PCT Pub. Date: Jun. 9, 2016

(65) Prior Publication Data

US 2017/0306429 A1 Oct. 26, 2017

(30) Foreign Application Priority Data

Dec. 1, 2014 (EP) ..... 14195644

(51) Int. Cl.
*C21D 6/00* (2006.01)
*C21D 1/18* (2006.01)
(Continued)

(52) U.S. Cl.
CPC ..... *C21D 6/005* (2013.01); *C21D 1/185* (2013.01); *C21D 1/26* (2013.01); *C22C 38/002* (2013.01);
(Continued)

(58) Field of Classification Search
None
See application file for complete search history.

(56) References Cited

U.S. PATENT DOCUMENTS

2013/0192726 A1* 8/2013 Chen ..... C22C 38/14 148/654
2017/0233841 A1* 8/2017 Larker ..... C21D 5/00 420/108
(Continued)

FOREIGN PATENT DOCUMENTS

CN 102925790 A 2/2013
CN 102943169 A 2/2013
(Continued)

OTHER PUBLICATIONS

Poliak, Thermomechanical Processing of Advanced High Strength Steels in Production Hot Strip Rolling, Lavorazioni plastiche, (Year: 2009).*
(Continued)

*Primary Examiner* — Anthony J Zimmer
*Assistant Examiner* — Michael J Kachmarik
(74) *Attorney, Agent, or Firm* — Notaro, Michalos & Zaccaria P.C.

(57) ABSTRACT

The en-bloc heat treatment of a manganese steel product whose alloy has a carbon fraction (C) in the following range 0.02≤C≤0.35% by weight, and a manganese content (Mn) in the following range of 3.5% by weight≤Mn≤6% by weight. The en-bloc annealing method has the following substeps: heating (E1) the steel product to a first holding temperature
(Continued)

(T1) which is in the range of 820° C.±20° C., first holding (H1) of the steel product during a first holding period (δ1) at the first holding temperature (T1), faster first cooling (A1) of the steel product to a second holding temperature (T2) which is in the range between 350° C. and 450° C., second holding (H2) of the steel product during a second holding period (δ2) in the range of the second holding temperature (T2), performing a slower second cooling (A2).

15 Claims, 2 Drawing Sheets

(51) Int. Cl.

| | |
|---|---|
| ***C21D 1/26*** | (2006.01) |
| ***C22C 38/04*** | (2006.01) |
| ***C22C 38/00*** | (2006.01) |
| ***C22C 38/06*** | (2006.01) |
| ***C22C 38/16*** | (2006.01) |

(52) U.S. Cl.
CPC ..... *C22C 38/04* (2013.01); *C22C 38/06* (2013.01); *C22C 38/16* (2013.01); *C21D 2211/002* (2013.01)

(56) References Cited

U.S. PATENT DOCUMENTS

| | | | | |
|---|---|---|---|---|
| 2018/0347018 | A1* | 12/2018 | Schulz | C21D 1/26 |
| 2019/0256942 | A1* | 8/2019 | Fan | C21D 8/0273 |

FOREIGN PATENT DOCUMENTS

| | | | |
|---|---|---|---|
| DE | 10332722 | B3 | 10/2004 |
| DE | 112006003169 | T5 | 1/2009 |
| EP | 2746409 | A1 | 6/2014 |
| JP | 2009-001909 | A | 1/2009 |
| WO | 2014094082 | A1 | 6/2014 |

OTHER PUBLICATIONS

First Notification of Office Action for corresponding Chinese patent application No. CN 201580065026.7, dated Mar. 5, 2018.
International Search Report for corresponding PCT application No. PCT/EP2015/078105, dated Feb. 3, 2016.

* cited by examiner

METHOD FOR THE HEAT TREATMENT OF A MANGANESE STEEL PRODUCT, AND MANGANESE STEEL PRODUCT HAVING A SPECIAL ALLOY

The present invention relates to a method for heat-treating a manganese steel product, which is also referred to here as a medium-manganese steel product. It also concerns a special alloy of a manganese steel product which is heat-treated within the scope of a special process.

The priority of the European patent application EP14195644.1 filed on 1 Dec. 2014 is claimed.

Both the composition, and the alloy respectively, and also the heat treatment in the production process have a marked influence on the properties of steel products.

It is known that the heating, holding and cooling during a heat treatment can have an influence on the final structure of a steel product. Furthermore, as already implied, the alloying composition of the steel product certainly also plays an important role. The thermodynamic and material-related relationships in alloyed steels are very complex and depend on many parameters.

It has been recognised that the mechanical properties and the deformability can be influenced by a combination of different phases and microstructures in the structure of a steel product.

Depending on the composition and heat treatment, ferrite, pearlite, residual austenite (also known as "retained austenite"), annealed martensite phases (also known as "tempered martensite"), martensite phases and bainite microstructures can be formed, inter glia, in steel products. The properties of steel alloys depend, among other things, on the proportions of the different phases, microstructures and their structural arrangement in the microscopic view.

Each of these phases and microstructures has different properties. The steel alloys, which have several such phases and microstructures, can therefore have distinctly different mechanical properties.

Depending on the specific requirements profile, different steels are used, for example, in automotive engineering. Several decades ago, in the automotive sector for car body construction, deep-drawing steels (e.g. IF steel) were usually used, which showed good deformability but only a low strength in the range of 120-400 N/mm$^2$. IF stands for "interstitial-free", i.e. this IF steel has only a small content of alloying elements which are embedded in interstitial spaces.

A significant component of today's steel alloys is manganese (Mn). The manganese content in % by weight is often in the range between 2.5 and 12%. These therefore concern so-called middle-manganese steels, which are also referred to as medium-manganese steels. Such medium-manganese steels are typically characterized by a structure consisting of a ferritic, martensite and austenite matrix. In this matrix, predominantly austenite is deposited at the grain boundaries as a second or third phase. The austenite has a strength-increasing effect. The proportion of martensite is usually 80-90% at a maximum by volume for medium-manganese steels. Due to this ambivalent structure combination, the medium-manganese steel has a relatively low yield strength with high tensile strength, which is favourable for the forming process.

FIG. 1 shows a classic, highly schematic diagram, in which the elongation at break is plotted as a percentage over the tensile strength in MPa (also referred to as ductility). The tensile strength in MPa allows a statement about the lower yield strength of a material. The diagram of FIG. 1 gives an overview of the strength classes of currently used steel materials. In general, the following statement applies: the higher the yield strength of a steel alloy, the lower the elongation at break of this alloy. In simplified terms it can be stated that the elongation at break decreases with increasing tensile strength and vice versa. Therefore an optimum compromise between the elongation at break and the tensile strength must be found for every application. FIG. 1 allows making statements about the relationship between the strength and the deformability of different steel materials.

The already mentioned medium-manganese steels are schematically summarised in the region which is designated by reference numeral 1. The region designated with reference numeral 1 comprises medium-manganese steels having an Mn content of between 3 and 7% by weight and having a carbon content of between 0.05 and 0.1% by weight.

Conventional medium-manganese steels are complex to produce since they are subjected to a two-step heat treatment. In order to increase the tensile strength in the case of the medium-manganese steels (e.g. from approx. 950 MPa to 1250 MPa), these steels are alloyed with manganese, for example, to obtain a martensitic phase. Unfortunately, however, it is necessary to simultaneously accept significantly reduced ductility. A medium-manganese steel having a high tensile strength of 1200 MPa for example typically has an elongation which is only between 2 and 8%.

The TRIP steels are designated by the reference numeral 2 and the so-called HD steels bear the reference numeral 3. TRIP stands for "TRansformation Induced Plasticity". HD stands for High Ductility.

In the automobile sector, a number of different steel alloys are used, each of which has been specifically optimised for its respective field of application on the vehicle. In the case of interior and exterior panels, structural parts and shock absorbers, alloys which have good energy absorption are used. Steel panels for the outer skin of a vehicle are relatively "soft" and have a yield strength below 140 MPa, for example. Such alloys have a lower tensile strength and a higher elongation at break. The steel alloys of shock absorbers have an elongation at break in the range between 600 and 1000 MPa, for example. The TRIP steels (reference numeral 2 in FIG. 1) are suitable for this purpose, for example.

For steel barriers (e.g. for side impact protection), which are intended to prevent the entry of vehicle parts in the event of an accident, steel alloys which have a high tensile strength of mostly more than 1000 MPa are used. In this case, for example, the new generation of high-strength AHSS HD steels is suitable. AHSS HD stands for "Advanced High-Strength Steels High Ductility".

These AHSS HD steels have, for example, a medium-manganese content in the range between 1.2 and 3.5% by weight and a carbon content (C) which is between 0.05 and 0.25% by weight.

It is suggested by the introductory explanations that the connections are very complex and that one can often achieve advantageous properties on the one hand only if one makes compromises on the other hand.

Above all, problems can arise with modern steel products of the 3$^{rd}$ generation in forming. Among other things, it is considered disadvantageous that martensite-containing steels require relatively high rolling forces during cold rolling. In addition, cracks can form in martensite-containing steels during cold rolling.

The assessment of experts is repeatedly confirmed who stress that steel alloys with a high tensile strength have to dispense with useful elongation at break.

It is therefore the object to provide a method for tempering (heat treating) and correspondingly manufactured steel products, which have high tensile strength and whose elongation at break is suitable for the use in the automotive sector and in other areas in which the deformability of the steel products is important.

Preferably, the steel products of the invention have a tensile strength $R_m$ (also called minimum strength), which is significantly greater than 1200 MPa. Preferably, the tensile strength should be even greater than 1400 MPa. The minimum elongation ($A_{80}$) should be 10%-20%.

Preferably, the steel products of the invention should allow a machining capability in the deep-drawing process.

According to the invention, a combination of process and alloying concepts provides a multi-phase steel product having an ultrafine structure and good mechanical forming capacity.

According to the invention, the alloy of the steel products of the invention has an average manganese content, which means that the manganese content is in the range of 3.5%, by weight≤Mn≤6% by weight. The manganese proportion is preferably in the range of 4% by weight≤Mn≤6% by weight in all embodiments.

The multi-phase steel products of the invention form a heterogeneous system or a heterogeneous structure.

In order to understand the interrelationships and to provide a suitable alloy as well as a special method for temperature treatment, numerous samples were subjected to X-ray examinations, TEM examinations, EBSD examinations and also examinations by light microscopy.

The steel products of the invention preferably have a microstructure according to the invention which comprises austenite, bainite as well as martensite, and a significantly reduced proportion of ferrite. The ferrite phase is relatively soft compared to the bainite phase. The replacement of the soft ferrite phase or matrix by a stronger and finer (nano-sized) bainite phase makes it possible to provide a steel product which has outstanding properties. Above all, replacing the ferrite phase or matrix with bainite leads to a marked increase in the hole expansion properties.

The steel products of the invention preferably have a proportion of a bainitic microstructure which is substantially greater than 5% by volume of the steel product in all embodiments. The proportion of the bainitic microstructure is particularly preferably in the range from 10 to 80% by volume. The proportion of the bainitic microstructure in the range of 20 to 40% by volume has been particularly well established.

The bainitic microstructure is particularly preferably characterized in that it has a very fine structure and that it comprises no or only a small amount of carbide.

The residual austenite content in all embodiments is preferably significantly less than 30% by volume. Preference is given to embodiments in which the residual austenite content is less than 10% by volume.

According to the invention, the steel products of the invention have preferably at least proportionally structures or regions with austenitic microstructure. The proportion of the austenitic microstructure is preferably in all embodiments in the range from 5 to 20% by volume of the steel product.

According to the invention, the steel products of the invention preferably proportionally have austenitic grains, which are distributed in an isotropic manner (i.e. independent of the direction) in the structure of the steel products. The volume fraction of the austenite grains is preferably in all embodiments less than 5%. The size of the austenite grains are preferably in all embodiments less than 1 μm.

According to the invention, the steel products of the invention have preferably in all embodiments a proportion of martensite which is lower than in other steel alloys whose tensile strength is in the range above 1000 MPa. The martensite content is usually 80 to 90% by volume in the case of previously known high-strength steel alloys. Although this lower martensite content of the steel product of the invention can be expected to have negative effects, the mechanical properties and the deep-drawing capability of the steel product according to the invention are unexpectedly good. The tensile strength $R_m$ of the steel products according to the invention in the range of 1400 MPa is significantly higher than the tensile strength which a steel alloy with conventionally large martensite content can offer.

The microstructure of the steel products according to the invention is characterized in that the comparatively low martensite content is in the form of lath-shaped martensite. These fine martensitic laths are found to have a positive effect on the tensile strength of the invention.

According to the invention, the steel products of the invention comprise proportionate structures or regions with ferrite. Preferably in all embodiments, the proportion of these structures or regions is in the range below 50% by volume of the steel product. The volume fraction of the ferrite phase is between 15 and 30%, wherein the ferrite phase forms a BCC lattice (BCC stands for body centred cubic) and has a low offset density. The grains of the ferrite phase usually have a slightly anisotropic extension.

All the embodiments of the steel product of the invention concern a so-called lower bainite. Such a lower bainite is characterized among other things in that the carbon diffusion is not sufficient because of the lower temperature of the bainite formation. This results in an oversaturation with carbon in the steel alloy according to the invention, which is depicted in fine carbide precipitations. The presence of these precipitations within the lath structure can be demonstrated by TEM studies.

The carbon content of the steel products of the invention is generally rather low. This means that the carbon content in the invention is in the range 0.02% by weight≤C≤0.35% by weight. Particularly preferred embodiments are those in which the carbon content is in one of the following ranges a. 0.05≤C≤0.22% by weight, or b. 0.09≤C≤0.18% by weight.

According to the invention, the alloy of the steel products comprises Al and Si components. The proportion of Al plus Si is preferably in all embodiments in the range ≤4% by weight. Preferably, the following condition applies: Al+Si<3% by weight. The addition especially of Al and Si in the stated weight percentage range leads unexpectedly to an improvement in the tensile strength and at the same time to an increased elongation at break. The admixture of Al and Si leads, among other things, to the bainite formation being promoted. As already mentioned, the bainite microstructure has a significant influence on the positive properties of the alloy of the steel products. Al and Si are also used to suppress carbide formation in the bainite, which further improves the positive properties of the alloy.

The proportion of Al and of Si can in all embodiments also be defined more precisely as follows: Si≤0.5% by weight and Al≤3% by weight.

According to the invention, the alloy of the steel products preferably comprises Al and Si components according to the following formula: Si+Al≤1% by weight.

According to the invention, the alloy of the steel products preferably has a phosphorus content. The proportion of P is preferably in all embodiments ≤0.03% by weight.

According to the invention, the alloy of the steel products preferably has a copper content. The proportion of Cu is preferably in all embodiments ≤0.1% by weight.

According to the invention, the steel products of the invention preferably have a small proportion of Nb, at least proportionally, so as to reduce the Ms temperature. Ms denotes the martensite starting temperature. The proportion of Nb in all embodiments is preferably less than 0.4% by weight. In this way the bainitic transformation can be controlled in an industrial production process. This bainitic transformation takes place during the temperature treatment according to the invention mainly during a phase of the so-called second holding and during the subsequent second cooling.

According to the invention, the steel products of the invention preferably have a small proportion of Ti, at least proportionally. The proportion of Ti is preferably in all embodiments less than 0.2% by weight.

According to the invention, the steel products of the invention have a small proportion of V, preferably at least proportionally. The proportion of V is preferably less than 0.1% by weight in all embodiments.

The described structure of the steel products with the indicated weight percentages is achieved by means of a special temperature treatment, which leads to controlled transformations and structure formations in the multi-phase steel product with a bainitic microstructure. This temperature treatment is referred to herein as an en-bloc temperature treatment since it comprises only a single continuously proceeding treatment process. This means that the en-bloc temperature treatment of the invention does not exhibit an interruption or pause after which the steel product would have to be reheated.

Thus, the invention does not need conventional ART annealing treatment. ART stands for "austenite reverted transformation".

The alloys described surprisingly lead to steel products having the desired properties, although they are only subjected to an en-bloc temperature treatment with the method steps according to claim 1. This specific form of the en-bloc temperature treatment has a significant influence on the formation of the specific ultrafine structure(s) of the steel product. The distances between the lamellae of the steel product are very small. A lath-like morphology is formed, or the microstructure of the steel product exhibits a lath-like morphology in which the width of the laths is preferably in a range between 10 nm and 350 nm.

There is a higher proportion of dislocations, which in turn leads to a higher strength of the steel product.

According to the invention, the structure or microstructure of the steel product is specifically controlled and determined by a special and efficient form of the en-bloc temperature treatment.

Preferably, the en-bloc temperature treatment comprises a phase of the rapid heating to a first holding temperature which is in the range around 820° C.±20° C. A first holding temperature of approx. 810° C. has proved to be especially successful. After the steel product is held in the range of the first holding temperature for a first time period (first holding time), a phase of rapid cooling takes place. During this rapid cooling, a second holding temperature is reached and an intermediate holding phase (second holding time) takes place in the range of this second holding temperature. The second holding temperature is between 350° C. and 450° C. Preferably in all embodiments, the second holding temperature is in the range between 380° C. and 450° C. After the steel product has been held for a second period of time in the region of the second holding temperature, a further phase of rapid cooling takes place.

The phase of rapid cooling preferably has a cooling rate in all embodiments, which is greater than −30 K/sec. Particularly preferred are cooling rates which are greater than −50 K/sec. These rapid cooling rates have an advantageous effect on the microstructure of the steel product of the invention.

The en-bloc temperature treatment of the invention serves to avoid the negative influences of the martensitic or ferritic matrix and at the same time to produce a new microstructure with the desired properties.

The first interim holding phase has preferably in all embodiments a maximum duration of 5 minutes.

The second interim holding phase has preferably in all embodiments a maximum duration of 10 minutes.

Preferably, the first holding time is shorter than the second holding time.

A bainitic transformation can specifically take place by holding in the range of the second holding temperature within the mentioned temperature window and during the subsequent rapid cooling.

The microstructure of the steel products is characterized in that it preferably comprises:

fine, lath-like bainite, ferritic phases with a high dislocation density, wherein the width of the laths is preferably in a range between 10 nm and 100 nm, and wherein the higher proportion of the dislocations leads to a hindrance of displacement movements.

In addition, the steel products of the invention preferably have an ultrafine grain size, the grain size being between 2 and 3 μm.

The fine, lath-shaped bainite, which is preferably a lower bainite, has been shown to improve the strength of the steel products of the invention.

The steel products of the invention have bainitic laths having a width between 10 and 350 nm. Preferably, in most embodiments, the width of the laths is between 10 nm and 100 nm. These bainitic laths, which are also referred to herein as nano-fine laths, form due to the special en-bloc temperature treatment.

The ferritic phases with high dislocation density play an important role, as they increase the elongation and forming capability of the steel products of the invention.

Owing to the specially developed alloy composition and the precisely coordinated structural fractions of austenite, bainite and martensite or ferrite, particularly good properties are achieved and, at the same time, the forming capacity of the steel products lies in a machine-manageable range.

Preferably, the invention is used to provide cold-rolled steel products in the form of cold-rolled flat products (e.g. coils). The invention can also be used, for example, to produce thin sheet or also wire and wire products.

It is an advantage of the method of the invention that it is less energy-consuming, faster and more cost-effective compared to many other process approaches.

The invention has the advantage among other things that no ART heat treatment is required. ART stands for "austenite reverted transformation".

Further advantageous embodiments of the invention form the subject matters of the dependent claims.

DRAWINGS

Embodiment examples of the invention are described in more detail below with reference to the drawings.

DETAILED DESCRIPTION

Figure 1:
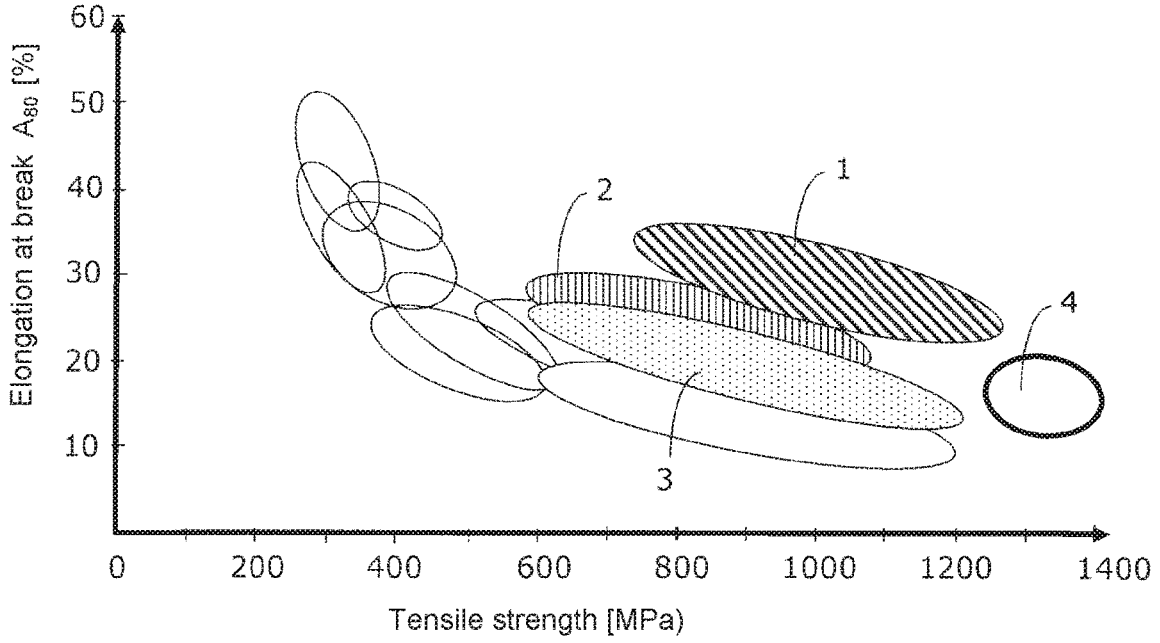
FIG. 1 is a highly schematic diagram in which the elongation at break is plotted as a percentage over the tensile strength in MPa for various steels.

According to the invention, the subject matter concerns ultrafine multi-phase medium-manganese steel products comprising martensite, ferrite and residual austenite regions or phases, as well as optionally also bainite microstructures. This means that the steel products of the invention are characterized by a special structure constellation, which is also referred to as a multiphase structure.

The following partly refers to steel (intermediate) products when it comes to emphasizing that not the finished steel product is concerned but a preliminary or intermediate product in a multi-stage production process. The starting point for such production processes is usually a melt. In the following, the alloy composition of the melt is given, since on this side of the production process the alloy composition can be influenced relatively precisely (e.g. by adding constituents such as silicon). In the normal case, the alloy composition of the steel product differs only slightly from the alloy composition of the melt.

The term "phase" is defined among other things by its composition of fractions of the components, enthalpy content and volume. Different phases are separated from each other in the steel product by phase boundaries.

The "components" or "constituents" of the phases can be either chemical elements (such as Mn, Ni, Al, Fe, C, . . . etc.) or neutral, molecule-like aggregates (such as FeSi, $Fe_3C$, $SiO_2$, etc.) or charged, molecule-like aggregates (such as $Fe^{2+}$, $Fe^{3+}$, etc.).

Specifications on quantities or proportions are made here in percent by weight (in short % by weight), unless otherwise stated. If specifications are given on the composition of the alloy or of the steel product, the composition, in addition to the explicitly listed materials or matters, comprises iron (Fe) as the base material and so-called unavoidable impurities, which always occur in the molten bath, and which also show up in the resulting steel product. All % by weight specifications are therefore always to be supplemented to 100% by weight and all % by volume specifications are always to be supplemented to 100% of the total volume.

The medium-manganese steel products of the invention all have a manganese content which is in the range of 3.5 and 6% by weight, wherein the stated limits belong to the range, i.e. the manganese content is in the range 3.5% by weights≤Mn≤6% by weight. The manganese content in all embodiments is preferably in the range 4% by weights≤Mn≤6% by weight.

In addition, the carbon content C in the following range is 0.02≤C≤0.35% by weight.

When preparing a manganese steel product, the following steps are carried out, among other things, wherein these steps do not necessarily have to follow one another immediately.

In the course of the provision of the alloy according to the invention, a carbon fraction C in the following range of 0.02≤C≤0.35% by weight, and a manganese content Mn in the following range 3.5% by weight≤Mn≤6% by weight are added to a starting amount of iron. The corresponding procedure is sufficiently known.

Within the framework of further processing of the alloy thus obtained, a particularly efficient annealing process (called en-bloc temperature treatment) follows. The word en-bloc is used herein to emphasize that, in contrast to numerous alternative approaches, no two-step annealing or temperature treatment is required.

When carrying out the en-bloc annealing process, the following partial steps are carried out (in this connection reference is made to FIG. 2):

- heating E1 of the steel (intermediate) product to a first holding temperature T1, which is in the range of 820° C.±20° C.,
- first holding H1 of the steel (intermediate) product during a first holding period δ1 at the first holding temperature T1,
- fast first cooling A1 of the steel (intermediate) product to a second holding temperature T2, which lies in the range between 350° C. and 450° C.,
- second holding H2 of the steel (intermediate) product during a second holding period δ2 in the range of the second holding temperature T2,
- performing a slow second cooling A2.

The first interim holding phase H1 has preferably in all embodiments a maximum duration of 5 minutes. The second interim holding phase H2 has preferably in all embodiments a maximum duration of 10 minutes.

The holding phase H2 can in all embodiments be carried out in a salt bath.

Particularly preferred embodiments are those in which the following applies: δ1+δ2<15 min and δ1<δ2.

The first cooling A1 can be effected in all embodiments in an air stream or by using a cooling fluid. In all embodiments, the second cooling A2 can take place in an air stream. However, the steel product of the invention can also be placed in a separate environment (e.g. in an annealing unit) in order to be held there for a longer period of time (at 300 to 450° C. for example). In this case, the time δ2 is extended correspondingly.

The phase of the rapid cooling A1 preferably has a cooling rate of more than −30 K/sec in all embodiments. Particular preference is given to the cooling rates A1, which are greater than −50 K/sec. These rapid cooling rates have an advantageous effect on the microstructure of the steel product of the invention.

Figure 2:
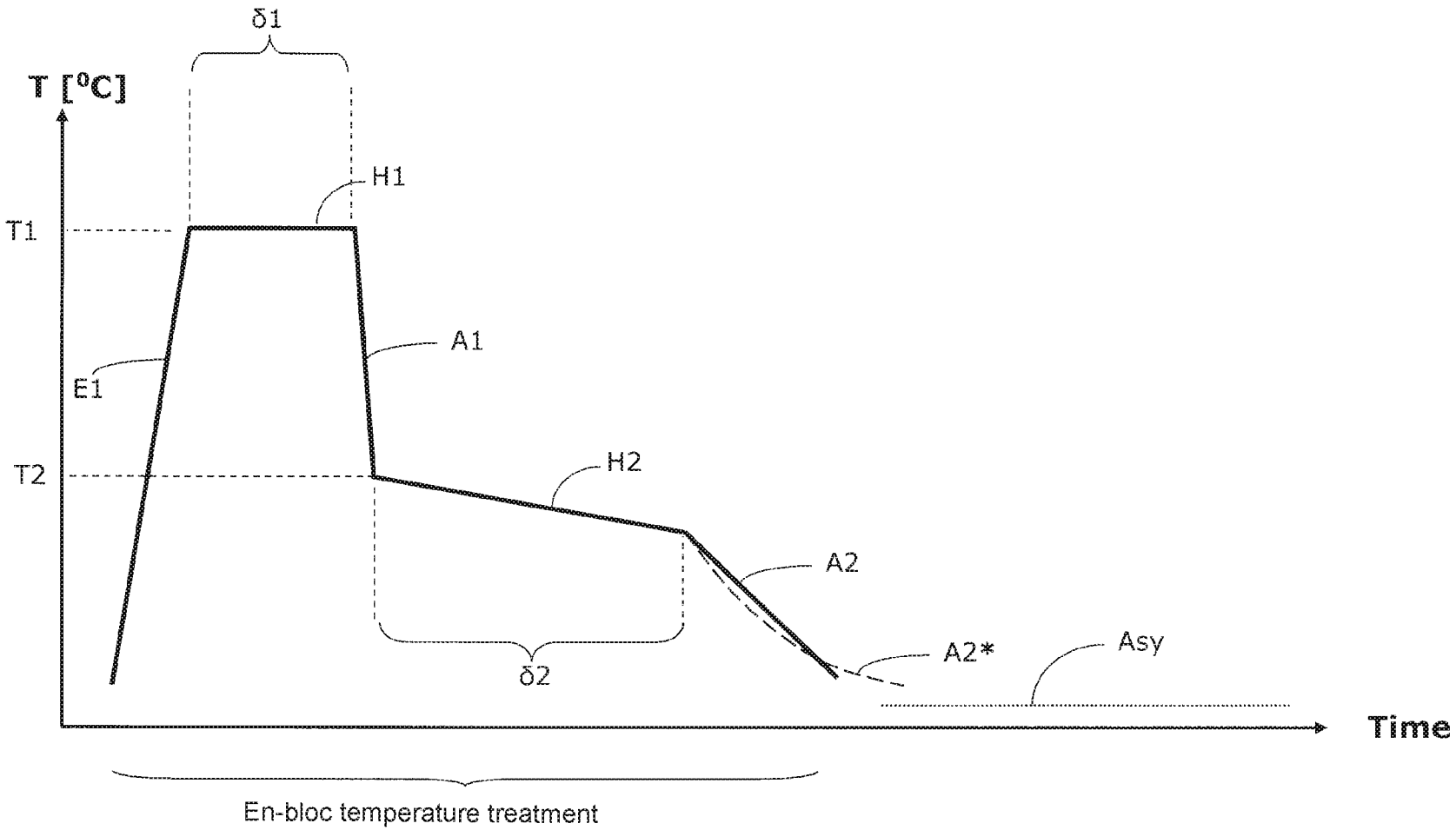
FIG. 2 is a schematic diagram of the unique temperature treatment employed as part of the manufacture of a steel product of the invention.

It can be seen in FIG. 2 that the faster first cooling A1 takes place with a cooling rate which is higher than the cooling rate of the slower second cooling A2. Preferably, the second cooling takes place in all embodiments along an asymptotic curve A2*, which approximates the asymptote Asy (see FIG. 2). Preferably, the steel product coils are left in all embodiments to themselves after the slower second cooling A2 or A2*, so that they can cool down slowly on their own.

According to the invention, preference is given to steel products which comprise, as a proportion, the following admixtures:

Al plus Si contents≤4% by weight, and/or
Nb content≤0.4% by weight, and/or
Ti content≤0.2% by weight, and/or
V content≤0.1% by weight, and/or
P content≤0.03% by weight, and/or
Cu content≤0.1% by weight.

According to the invention, steel products are preferred which comprise a proportion of a bainitic microstructure which is greater than 5% by weight of the steel product, wherein the proportion of the bainitic microstructure is preferably in the range from 10 to 70% by volume of the steel product. The proportion of the microstructure is particularly preferably in the range from 20 to 40% by volume.

According to the invention, steel products are preferred which comprise a residual austenite content which is less than 30% by volume of the steel product, wherein the residual austenite content is preferably less than 10% by volume of the steel product.

According to the invention, steel products are preferred which have a proportion of an austenitic microstructure, which is in the range from 5 to 20% by volume of the steel product, in particular from 2 to 10% by volume.

According to the invention, steel products are preferred which comprise a volume content of austenite grains which preferably amounts to less than 5% of the total volume of the steel product. These austenitic grains preferably have a maximum size which is less than 1 μm.

LIST OF REFERENCE NUMERALS

| | |
|---|---|
| Medium-manganese steels | 1 |
| TRIP steels | 2 |
| HD tempering | 3 |
| First cooling | A1 |
| Second cooling | A2 |
| Asymptote | Asy |
| First holding period | δ1 |
| Second holding period | δ2 |
| Heating | E1 |
| First holding | H1 |
| Second holding | H2 |
| First holding temperature | T1 |
| Second holding temperature | T2 |

The invention claimed is:

1. A method for producing a manganese steel product, the method comprising the following steps:

providing a steel product of an alloy which comprises:

a carbon fraction (C) in the following range 0.02≤C≤0.35% by weight, and a manganese content (Mn) in the following range of 3.5% by weight≤Mn≤6% by weight, iron (Fe) as base material and unavoidable impurities;

carrying out an en-bloc annealing process with the provided steel product, wherein the en-bloc annealing process consists of the following temperature treatment steps:

heating (E1) the steel product to a first holding temperature (T1) which is in the range of 820° C.±20° C., first holding (H1) of the steel product during a first holding period (δ1) at the first holding temperature (T1), faster first cooling (A1) of the steel product to a second holding temperature (T2) which is in the range between 350° C. and 450° C., second holding (H2) of the steel product during a second holding period (δ2) in the range of the second holding temperature (T2), wherein the first holding period (δ1) is shorter than the second holding period (δ2), performing a slower second cooling (A2), wherein the faster first cooling (A1) is performed at a cooling rate higher than the cooling rate of the slower second cooling (A2).

2. A method according to claim 1, characterized in that the carbon content (C) lies in one of the following ranges:

a) 0.05≤C≤0.22% by weight, or b) 0.09≤C≤0.18% by weight.

3. A method according to claim 1, characterized in that the manganese content (Mn) lies in the range of 4% by weight≤Mn≤6% by weight.

4. A method according to claim 1, characterized in that the manganese steel product is wound during the slower second cooling (A2).

5. A method according to claim 1, characterized in that the second cooling (A2) has a curve-shaped.

6. A method according to claim 1, characterized in that the temperature of the manganese steel product is constant during the second holding (H2) in the range of the second holding temperature (F2) or decreases with time.

7. Method according to claim 1, characterized in that when providing the alloy the following admixtures are carried out:

Al plus Si contents≤4% by weight, and/or

P content≤0.03% by weight, and/or

Cu content≤0.1% by weight.

8. A method according to claim 1, characterized in that the first holding period (δ1) has a duration of at most 10 minutes and the second holding period (δ2) has a respective maximum duration of 15 minutes.

9. A method according to claim 1, characterized in that the manganese steel product has bainitic laths having a width between 10 and 350 nm.

10. A method according to claim 1, characterized in that the manganese steel product concerns a medium-manganese steel product which has a bainitic microstructure whose content is greater than 5% by volume of the steel product.

11. A method according to claim 5, characterized in that the second cooling (A2) has an asymptotic progression whose asymptote (Asy) is at 100° C.

12. A method according to claim 8, characterized in that the following applies: δ1≤5 min and δ2≤10 min.

13. A method according to claim 9, characterized in that the manganese steel product has bainitic laths having a width between 10 nm and 100 nm.

14. A method according to claim 10, characterized in that the manganese steel product has a bainitic microstructure whose content is in the range from 10 to 80% by volume.

15. A method according to claim 14, characterized in that the manganese steel product has a bainitic microstructure whose content is in the range from 20 to 40% by volume.

* * * * *